US006889741B1

(12) United States Patent
Cheng et al.

(10) Patent No.: US 6,889,741 B1
(45) Date of Patent: May 10, 2005

(54) WINDOW COVERING HEIGHT ADJUSTMENT APPARATUS AND METHOD USING MULTIPLE INTERCONNECTED CORD WINDING ROTORS

(75) Inventors: Li-Ming Cheng, Kaohsiung (TW); Lawrence S. Wu, Rowland Heights, CA (US)

(73) Assignee: Zipshade Industrial (B.V.I.) Corp., Diamond Bar, CA (US)

( * ) Notice: Subject to any disclaimer, the term of this patent is extended or adjusted under 35 U.S.C. 154(b) by 2 days.

(21) Appl. No.: 10/237,225

(22) Filed: Sep. 9, 2002

Related U.S. Application Data

(60) Provisional application No. 60/388,519, filed on Jun. 11, 2002.

(51) Int. Cl.[7] ..... E06B 9/30
(52) U.S. Cl. ..... 160/170
(58) Field of Search ..... 160/170, 171; 254/295; 242/388.6; E06B 9/34, 9/32, 9/322

(56) References Cited

U.S. PATENT DOCUMENTS 1,749,060 A * 3/1930 Beaumont ..... 254/295
3,912,229 A * 10/1975 Mitchell ..... 254/295
5,799,715 A * 9/1998 Biro et al. ..... 160/170
6,085,824 A * 7/2000 Cadorette ..... 160/321
6,283,192 B1 * 9/2001 Toti ..... 160/170
6,330,899 B1 * 12/2001 Ciuca et al. ..... 160/170

FOREIGN PATENT DOCUMENTS

CH 280089 * 4/1952
DK 81752 * 1/1957
IT 401238 * 10/1945

* cited by examiner

*Primary Examiner*—Blair M. Johnson
(74) *Attorney, Agent, or Firm*—William W. Haefliger

(57) ABSTRACT

Apparatus for raising and lowering a window shade, comprising first and second lines movable together to raise and lower the shade, a third line, which is a control line, and first, second and third rotors to which the first and second and third lines are respectively connected, whereby when the third line is displaced, the third rotor rotates to effect rotation of the first and second rotors to displace the first and second dines to raise or lower the shade.

12 Claims, 3 Drawing Sheets

WINDOW COVERING HEIGHT ADJUSTMENT APPARATUS AND METHOD USING MULTIPLE INTERCONNECTED CORD WINDING ROTORS

This application claim priority from provisional application Ser. No. 60/388,519, filed Jun. 11, 2002.

BACKGROUND OF THE INVENTION

This invention relates generally to height adjustment of window shades or coverings, and more particularly concerns apparatus and methods for such adjustment by using multiple interconnected cord winding rotors.

There is need for easy to use, safe, methods and apparatus wherein multiple cords are adjusted vertically to raise and lower window coverings or shades. In particular, there is need for a simple effective way to employ only one manually adjustable cord to control multiple shade height adjustment cords. The herein disclosed apparatus and method achieves these objectives in an unusually effective way, providing superior results.

SUMMARY OF THE INVENTION

It is a major object of the invention to provide improvements in apparatus for raising and lowering a window shade, such apparatus basically comprising a) first and second lines movable together to raise and lower the shade, b) a third line, which is a control line, c) and first, second and third rotors to which the first and second and third lines are respectively connected, whereby when the third line is displaced, the third rotor rotates to effect rotation of the first and second rotors to displace the first and second lines to raise or lower the shade.

Another object is to provide for third rotor rotatable coupling to the second rotor, the second rotor rotatably coupled to the first rotor. Such rotors may have toothed intercoupling, such as gear teeth, as will be seen, and the second rotor may be located between the first and third rotors to minimize the overall size of the rotor assembly located proximate the top of the shade to be raised and lowered, for concealment.

A further object is to locate the first and second lines or cords to extend downwardly for attachment to the shade, and the third line extends to an anchor connection, for example to the window frame. As will be understood, a pulley or pulleys may be used, to entrain the first line, or to entrain both the first and third lines.

Yet another object is to use an additional rotor operatively interconnected to the first rotor to displace an auxiliary line to assist in raising and lowering of the shade.

Another object is to provide pulleys entraining the first line, or the first and third lines, or the first and auxiliary lines.

These and other objects and advantages of the invention, as well as the details of an illustrative embodiment, will be more fully understood from the following specification and drawings, in which;

DRAWING DESCRIPTION

DETAILED DESCRIPTION

Figure 1:
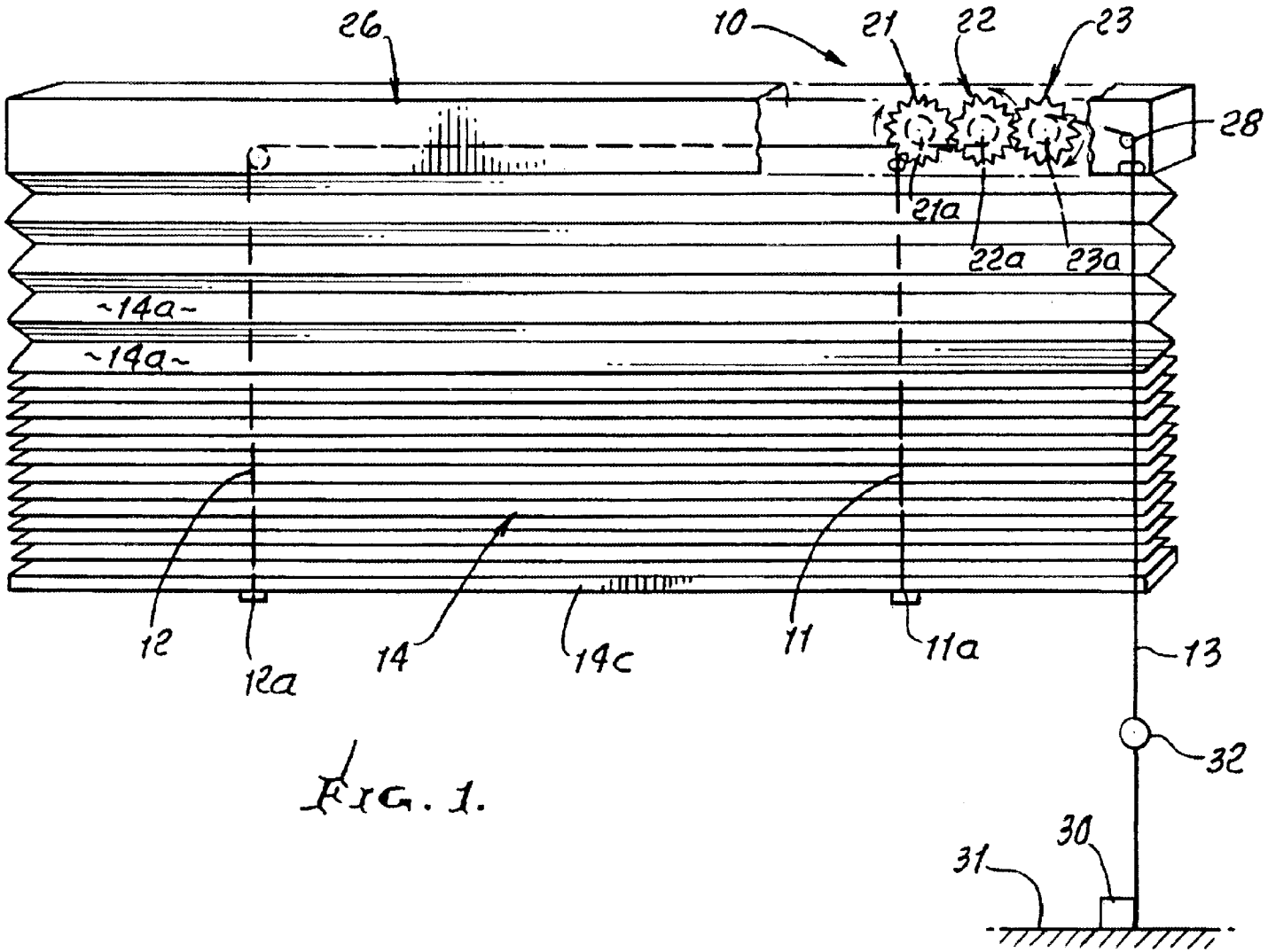
FIG. 1 is a front elevation showing apparatus incorporating the invention.
Figure 2:
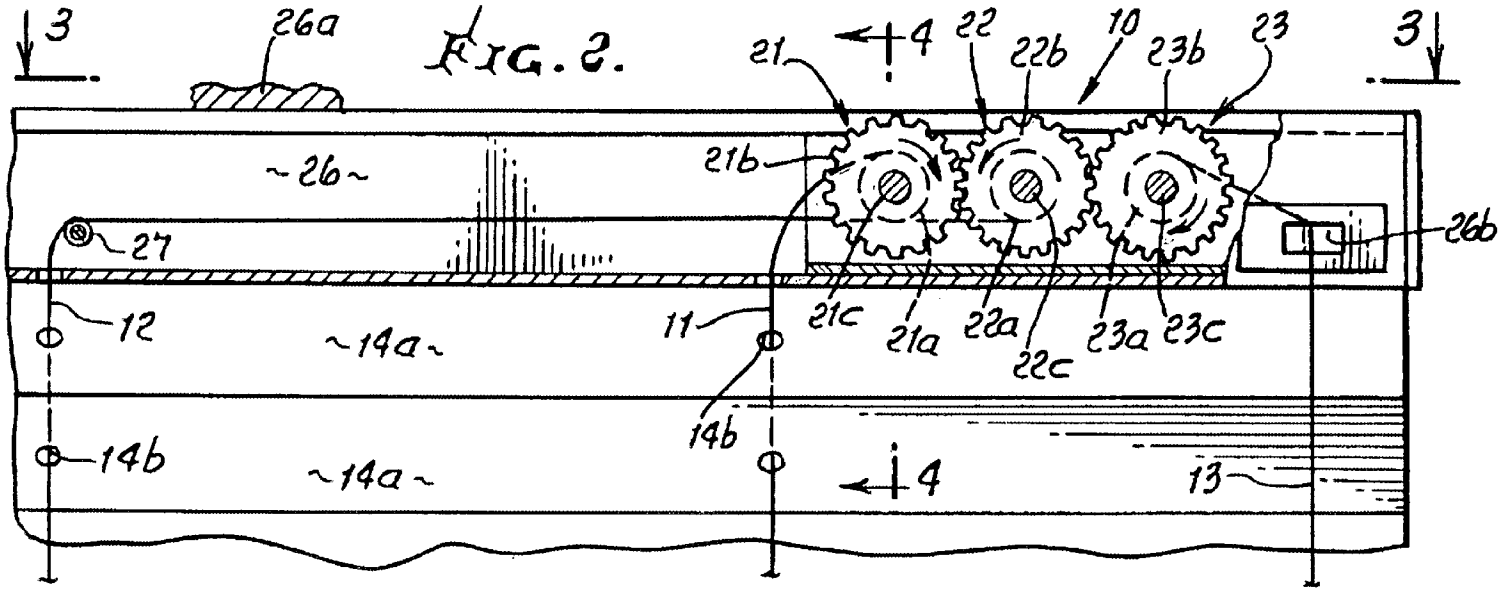
FIG. 2 is a frontal view like FIG. 1 but showing the three rotors enlarged, and in further detail.

As is shown in FIGS. 1 and 2, apparatus 10 for raising and lowering a window shade comprises a first line or cord 11 and a second line or cord 12, which are movable together to raise and lower the shade 14. A third line or cord 13, which is a control line, can be moved up or down to control lines 11 and 12. The lower ends 11*a* and 12*a* of lines 11 and 12 are attached to a lower part 14*c* of the shade 14. Typically, lines 11 and 12 pass through openings 14*b* in shade slats 14*a*, and when lines 11 and 12 are pulled up, the shade progressively collapses in an upward direction, i.e. pulled up by part 14*c*.

First line or cord 11 is connected to a first rotor 21; second line 12 is connected to second rotor 22; and third line 13 is connected to third rotor 23. Typically, the connections are provided by rotor drums 21*a*, 22*a* and 23*a*, about which the lines are spooled. As single line 13 is pulled down, it unwinds off drum 23*a* as rotor 23 rotates clockwise in FIG. 2; and this causes counterclockwise rotation of drum 22*a* and clockwise rotation of drum 21*a* to wind up lines 11 and 12, at the same rate, raising the shade. As single line 13 is allowed to travel upwardly, lines 11 and 12 move downwardly, to lower the shade to an adjustable or selected level.

The rotors typically have gear teeth, as at 21*b*, 22*b* and 23*b*, with teeth 21*b* and 22*b* meshing, and teeth 22*b* and 23*b* meshing, the rotors and teeth being alike. Rotor 22 is preferably located between rotors 21 and 23.

Figure 3:
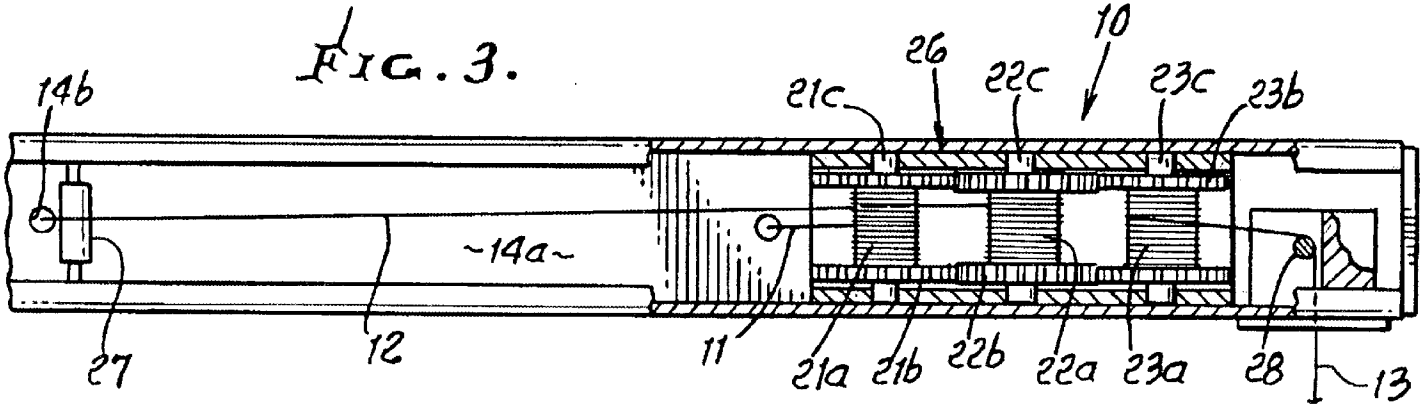
FIG. 3 is a top plan view taken on lines 3-3 of FIG. 2.
Figure 4:
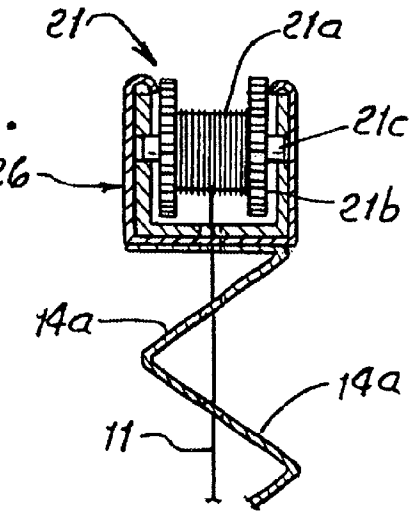
FIG. 4 is an enlarged vertical section taken on lines 4-4- of FIG. 2.

The rotors are typically supported by parallel shafts 21*c*, 22*c* and 23*c*, and the shafts are carried by a housing or "head rail" 26, located at the top or head of the shade, and attached to the window frame top horizontal structure 26*a*. Rotors 21–23 are located in a row within 26, for compact assembly. See also FIGS. 3 and 4, also showing two gears (forming the teeth) attached to each shaft, for stability.

Line 12 may typically be entrained by a pulley 27, carried by housing 26, which redirects line 12 from vertical to horizontal so as to extend to drum 22; line 11 extends downwardly from drum 21*a*; and line 13 is typically entrained by pulley 28 carried by 26, which re-directs line 13 toward drum 23*a*. Head rail or housing 26 may be configured in 2 sections, relatively endwise adjustable to accommodate to different window widths. A window 26*b* in 26 allows passage of adjusting line 13 to the front of 26.

A releasable hold-down such as a bracket for line or cord 13 is shown at 30, attached to the window frame portion 31; and a grip 32 may be carried by the line 13.

Need for two control lines to control lines 11 and 12 is obviated, and risk of user entanglement by two such lines is not presented.

As is clear from the above. FIGS. 1–4 represent one preferred form of the invention, the basic elements comprising:

a) first and second lines movable together to raise and lower the shade, d) a third line, which is a control line, c) and first, second and third rotors to which the first and second and third lines are respectively connected, whereby when the third line is displaced, the third rotor rotates to effect rotation of the first and second rotors to displace the first and second lines to raise or lower the shade.

The method of raising or lowering a window shade includes:

$x_1$) providing apparatus as listed above at a), b) and c);

$x_2$) displacing said the line to effect simultaneous raising or lowering of the first and second lines, $x_3$) and anchoring the third line at a position of corresponding shade vertical positioning as effected by said first and second lines.

Figure 5:
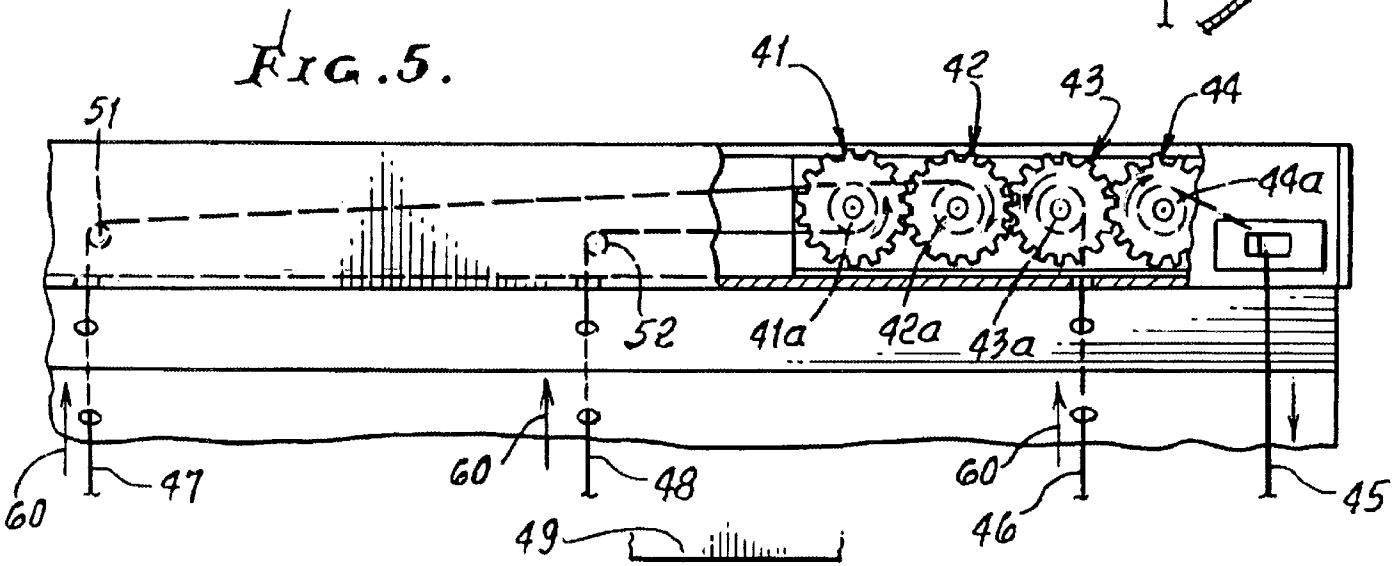
FIG. 5 is a view like FIG. 2, showing a modification.

In FIG. 5, four rotors are employed, and designated at 41, 42, 43 and 44, and interconnected as shown, in series, by meshing teeth. Such rotors are like rotors as described in FIGS. 1 and 2. As manually manipulable line 45 is pulled downwardly, three lines 46, 47 and 48 are pulled upwardly by rotation of the rotors in the direction indicated by arrows 60 at the rotors. Lines 46–48 then lift the shade via its lowermost slat 49 to which those lines are connected, as shown. Rotor drum 41*a* winds line 48; rotor drum 42*a* winds line 47, rotor drum 43*a* winds line 46; and rotor drum 44*a* winds line 45. Pulleys 51 and 52 entrain and turn lines 47 and 48, as shown. Line 45 corresponds to line 13 in its functioning and operation, elements corresponding to 30 and 32 being provided, for line 45.

Rotor 43 controlling line 46 corresponds to rotor 21; rotor 42 controlling line 47 corresponds to rotor 22; rotor 44 controlled by line 45 corresponds to rotor 23; and rotor 41 is an additional rotor, controlling the added intermediate line 48 (i.e. intermediate lines 46 and 47). Four line support and control of the shade is thereby provided.

We claim:

1. Apparatus for raising and lowering a window shade, comprising a) first and second lines movable together to raise and lower the shade, b) a third line, which is a control line, c) and first, second and third rotors to which the first and second and third lines are respectively connected, whereby when the third line is displaced, the third rotor rotates to effect rotation of the first and second rotors to displace the first and second lines to raise or lower the shade, d) and wherein the third rotor is rotatably engaged with the second rotor, and the second rotor is rotatably engaged with the first rotor, e) and where the first and second lines extend downwardly for attachment to the shade, and the third line extends generally downwardly to a releasable hold-down connection.

2. The apparatus of claim 1 in which the rotors have toothed coupling.

3. The apparatus of claim 2 in which the second rotor is located between the first and third rotors.

4. The apparatus of claim 1 including a pulley or pulleys to entrain the first line, or the first and third lines.

5. The apparatus of claim 2 wherein the toothed coupling is defined by gear teeth.

6. The apparatus of claim 1 including an auxiliary rotor operatively interconnected to at least one of the first and second rotors to displace an auxiliary line for assisting in raising and lowering of the shade.

7. The apparatus of claim 6 wherein said first and second rotors are located between the third and auxiliary rotors.

8. The apparatus of claim 1 wherein the rotors include line winding drums.

9. The apparatus of claim 6 wherein said rotors include line winding drums.

10. The apparatus of claim 1 wherein the first, second and third lines wind on first, second and third drums respectively associated with the first, second and third rotors.

11. The apparatus of claim 6 wherein the first, second, third and auxiliary lines wind on first, second and third drums respectively associated with the first, second and third rotors, and on an auxiliary drum associated with said auxiliary rotor.

12. The apparatus of claim 11 including pulleys entraining said first and auxiliary lines.

* * * * *